US011832088B2

(12) United States Patent
Stack et al.

(10) Patent No.: US 11,832,088 B2
(45) Date of Patent: Nov. 28, 2023

(54) METHOD FOR BI-PHASIC SEPARATION AND RE-INTEGRATION ON MOBILE MEDIA DEVICES

(71) Applicant: TGR1.618 LIMITED, London (GB)

(72) Inventors: Randall Joseph Stack, Glastonbury (GB); Don Wayne Estes, Santa Monica, CA (US)

( * ) Notice: Subject to any disclaimer, the term of this patent is extended or adjusted under 35 U.S.C. 154(b) by 0 days.

(21) Appl. No.: 17/792,988

(22) PCT Filed: Jan. 15, 2021

(86) PCT No.: PCT/IB2021/050292
§ 371 (c)(1),
(2) Date: Jul. 14, 2022

(87) PCT Pub. No.: WO2021/144751
PCT Pub. Date: Jul. 22, 2021

(65) Prior Publication Data

US 2023/0129214 A1 Apr. 27, 2023

(30) Foreign Application Priority Data

Jan. 15, 2020 (GB) ..... 2000632

(51) Int. Cl.
*H04S 7/00* (2006.01)
*H04S 1/00* (2006.01)

(52) U.S. Cl.
CPC ..... *H04S 7/307* (2013.01); *H04S 1/00* (2013.01); *H04S 2400/09* (2013.01)

(58) Field of Classification Search
None
See application file for complete search history.

(56) References Cited

U.S. PATENT DOCUMENTS

2014/0164455 A1* 6/2014 Estes ..... G06F 17/14 708/410

* cited by examiner

*Primary Examiner* — Kenny H Truong
(74) *Attorney, Agent, or Firm* — RC Trademark Company

(57) ABSTRACT

Disclosed is a method of presenting audio information to a user. The method comprising receiving samples of a waveform from a media handling component, initializing a biquad filter with a set of one or more coefficients corresponding to a set of one or more stages of the biquad filter for both a real component of the samples and an imaginary component of the samples. The biquad filter is implemented on a media processing component of the mobile media device. The method further comprises applying the biquad filter to the samples of the waveform to generate an output for presentation to the user, the output comprising a processed rendering of the real component of the samples and the imaginary component of the samples.

18 Claims, 1 Drawing Sheet

METHOD FOR BI-PHASIC SEPARATION AND RE-INTEGRATION ON MOBILE MEDIA DEVICES

TECHNICAL FIELD

The present embodiments relate to audio signal processing; and more specifically, to a method of Bi-phasic separation and re-integration on Mobile Media Devices.

BACKGROUND

Signal processing has been widely acknowledged since its development, owing to wide application thereof. Over the years, many ideas have been put forth in an ever-increasing attempt to provide real audio experiences to users. Notably, continuous advancements have been made to hardware and software of audio technologies to provide good listening experiences to users.

Typically, during a live performance (for example, a music concert, recording, and the like), a listener experiences audio signals from multiple sources, scattered in space. Moreover, the listener also experiences reflections of the audio signals that bounce off of reflective surfaces in the environment. The audio signals from the source and reflections thereof hit ears of the listener at different times and at different angles. Such interaction of the listener with different phase components of the audio signals provide a holistic real experience for the listener. However, playing the audio signals from a recorded medium does not reproduce the same experience for the listener as the live performance. Typically, the loss of live experience occurs as phase components of an audio signal become locked together in a corresponding relationship at time of recording the audio signal.

Formerly, monaural sound was provided to listener, but this had spatial shortcomings. Stereo was invented to address this issue and create better spatial effects for audio signals. Numerous attempts have been made to provide a more spatial or immersive audio experience, in addition to attempts to improve the quality of audio signals before presenting them to the listener. However, spatial effects created by stereo are merely artificial simulations of the real environment and a psychoacoustic trick on the brain of the listener that makes it seem as though natural factors are present.

Conventionally, artificial reverberation is used to create a perception of the real environment, whilst frequency equalization and/or dynamic range compression are used to create a perception of a difference in quality and amplitude for the audio signals. However, said mechanisms for the processing of audio signals are artificial and often negatively affect the frequency spectrum associated with the original signal. Moreover, current audio technologies often require special hardware for artificial processing of the audio signals in advance of being presented to the listener. Furthermore, data compression technologies (for example, MP3, encoders, and the like) further amplify problems associated with artificial processing of the audio signals by ignoring one or more phase components altogether.

Listeners interact most heavily with audio signals on their mobile devices (for example, cellular phones, audio players, and the like). However, a lack of applications for processing audio signals using Bi-phasic separation and re-integration, results in an ordinary audio experience for the listener that is far from real. Moreover, other spatial or sound improvement technologies require special equipment or desktop computers, further restricting mobile users from experiencing high quality sound. Furthermore, transformation of the audio signals using such spatial or sound improvement technologies modifies the spectral content of the original signal which generates subjective results.

SUMMARY

The present disclosure describes a method of presenting audio information to a user. The present disclosure also describes methods for mobile media devices to present audio information to a user. The present disclosure describes a solution to the existing problem of loss of phase components during processing of audio signals using conventional audio technologies; and restricted availability of advanced audio technologies that execute advanced processing of audio signals for holistic experiences for the user. An aim of the present disclosure is to provide a solution that overcomes the problems encountered in prior art, and provides a method for implementing advanced mathematical constructs for processing audio signals using biquad filters.

In one aspect, an embodiment of the present disclosure provides a method of presenting audio information to a user, comprising:

- receiving samples of a waveform from a media handling component of a mobile media device;
- initializing a biquad filter with a set of one or more coefficients corresponding to a set of one or more stages of the biquad filter for both a real component of the samples and an imaginary component of the samples, wherein the biquad filter is implemented on a media processing component of the mobile media device; and
- applying the biquad filter to the samples of the waveform to generate an output for presentation to the user, the output comprising of a processed rendering of the real component of the samples and the imaginary component of the samples.

In another aspect, an embodiment of the present disclosure provides a mobile media application for presenting audio information to a user, comprising:

- a media handling component configured to generate samples of a waveform;
- a media management unit configured to initialize a biquad filter with a set of one or more coefficients corresponding to a set of one or more stages of the biquad filter for both a real component of the samples and an imaginary component of the samples; and
- a media processing component connected to the media management unit and the media handling component, the media processing component configured to receive the set of one or more coefficients and to apply the biquad filter to the samples of the waveform to generate an output for presentation to a user, the output comprising a processed rendering of the real component of the samples and the imaginary component of the samples.

Embodiments of the present disclosure substantially eliminate the aforementioned problems in the prior art, and enable processing of audio signals by employing biquad filters that are optimized to perform transforms on the audio signal, wherein the biquad filters are implemented with a portable media device and further conserve different phase components of the audio signal.

Additional aspects, advantages, features and objects of the present disclosure would be made apparent from the drawings and the detailed description of the illustrative embodiments construed in conjunction with the appended claims that follow.

It will be appreciated that features of the present disclosure may be drawn together in various combinations without departing from the scope of the present disclosure as defined by the appended claims.

BRIEF DESCRIPTION OF THE DRAWINGS

The summary above, as well as the following detailed description of illustrative embodiments, may be read in conjunction with the drawings. For the purpose of illustrating the present disclosure, exemplary constructions of the disclosure are shown in the drawings. However, the present disclosure is not limited to specific methods and instrumentalities disclosed herein. Moreover, those in the art will understand that the drawings are not to scale, unless otherwise stated in the specification. Wherever possible, like elements have been indicated by identical numbers.

Embodiments of the present disclosure will now be described, by way of example only, with reference to the following diagrams wherein.

Figure 1:
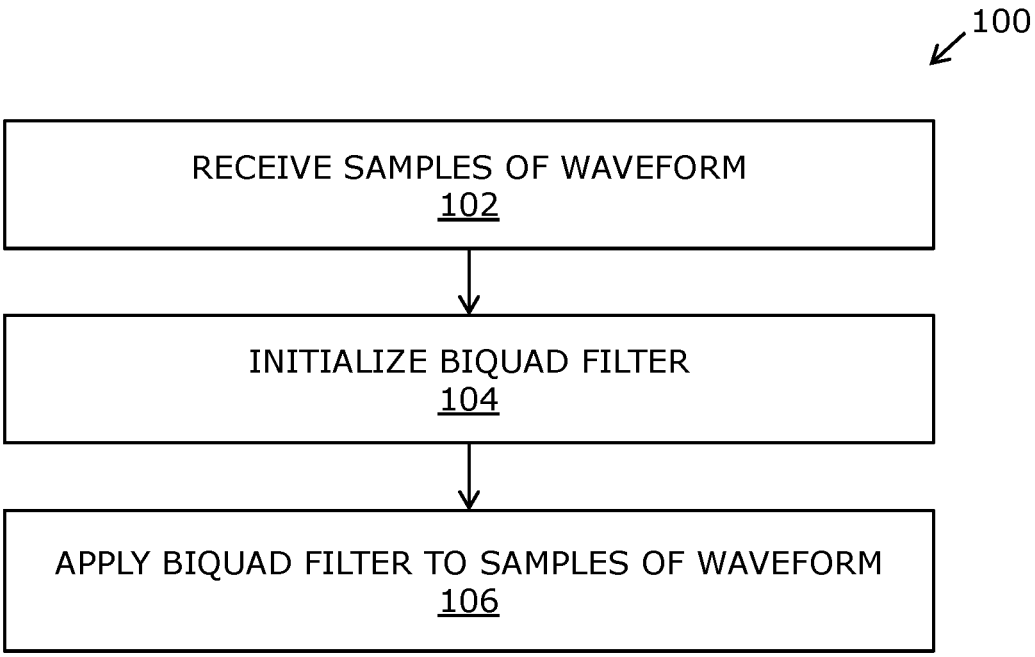
FIG. 1 is a schematic illustration of a flow chart depicting steps of a method of presenting audio information to a user.

In the accompanying drawings, an underlined number is employed to represent an item over which the underlined number is positioned or an item to which the underlined number is adjacent. A non-underlined number relates to an item identified by a line linking the non-underlined number to the item. When a number is non-underlined and accompanied by an associated arrow, the non-underlined number is used to identify a general item at which the arrow is pointing.

DETAILED DESCRIPTION OF EMBODIMENTS

The following detailed description illustrates embodiments of the present disclosure and ways in which they can be implemented. Although some modes of carrying out the present disclosure have been disclosed, those skilled in the art would recognize that other embodiments for carrying out or practicing the present disclosure are also possible.

In one aspect, an embodiment of the present disclosure provides a method of presenting audio information to a user, comprising:

- receiving samples of a waveform from a media handling component of a mobile media device;
- initializing a biquad filter with a set of one or more coefficients corresponding to a set of one or more stages of the biquad filter for both a real component of the samples and an imaginary component of the samples, wherein the biquad filter is implemented on a media processing component of the mobile media device; and
- applying the biquad filter to the samples of the waveform to generate an output for presentation to the user, the output comprising a processed rendering of the real component of the samples and the imaginary component of the samples.

In another aspect, an embodiment of the present disclosure provides a mobile media device for presenting audio information to a user, comprising:

- a media handling component configured to generate samples of a waveform;
- a media management unit configured to initialize a biquad filter with a set of one or more coefficients corresponding to a set of one or more stages of the biquad filter for both a real component of the samples and an imaginary component of the samples; and
- a media processing component coupled to the media management unit and the media handling component, the media processing component configured to receive the set of one or more coefficients and to apply the biquad filter to the samples of the waveform to generate an output for presentation to a user, the output comprising a processed rendering of the real component of the samples and the imaginary component of the samples.

The present disclosure discloses the method for presenting audio information to the user. Specifically, the information is a processed audio signal obtained by performing the steps of the method on the waveform. Specifically, the method is executed to perform transforms on the samples of the waveform, wherein the samples are transformed using biquad filters. Therefore, the method does not employ applications designed using specialized digital signal processing platforms (for example, Max MSP) that have restricted presence, specifically, only generating applications for desktop computers. Notably, the method is implemented efficiently on the mobile media device thereby hugely increasing portability of advanced signal processing. Notably, the set of one or more coefficients corresponding to the set of one or more stages of the biquad filter are experimentally realized and ensure stable and loss-less transformation of the samples of the waveform even at higher frequencies of the samples. Additionally, the biquad filter is optimized to perform the transformation at lower computational power and in a uniform manner for each of the samples of the waveform. The method, implemented for the audio signal, provides improved cognitive effects for the user as compared to conventional audio technologies. Therefore, when the transformed audio signals are presented to the user, the user experiences an immersive audio experience that is closely related to the original audio signal.

It will be appreciated that the aforesaid method may be implemented on non-mobile computing devices, specifically, non-mobile media devices that are not portable, for example, desktop computers.

The present disclosure describes the method of presenting audio information to the user. In this regard, the information presented to the user represents or conveys a content by a particular arrangement or sequence of entities of the content. Specifically, the information is presented to the user as a digital file. More specifically, the digital file comprises a processed waveform (signal) representing audio information. The audio information to be presented to the user is a processed waveform associated with, for example, a piece of music.

Moreover, the user refers to a person, wherein the user is a consumer of the audio information. Optionally, the user is a person operating a system (namely, the mobile media device), wherein the system performs the aforementioned steps of the method described herein.

The method of presenting audio information to the user is implemented by the mobile media device. Notably, the mobile media device refers to an electronic device associated with (or used by) the user, that is capable of performing specific tasks associated with the aforementioned method. Furthermore, the mobile media device is intended to be broadly interpreted to include any electronic device that may be used for voice and/or data communication over a wireless communication network. Examples of the mobile media device include, but are not limited to, cellular phones, personal digital assistants (PDAs), handheld devices, tablet computers, media player, etc. Additionally, the mobile media device includes at least one of: casing, memory, one or more processors, a network interface, a microphone, a speaker, a keypad, a display.

The method of presenting audio information to the user comprises receiving samples of the waveform from the media handling component of the mobile media device. Notably, the media handling component of the mobile media device refers to a computational element that is configured to generate the samples of the waveform. Optionally, the media handling component includes, but is not limited to, a microprocessor, a microcontroller, a type of processing circuit, a network adapter, and memory. Furthermore, the media handling component may include one or more individual processors, processing devices and various elements associated with a processing device that may be shared by other processing devices. Optionally, the media handling component is executed as a set of instructions on the one or more processors of the mobile media device. Moreover, optionally, the media handling component is executed as an independent computational element inside the mobile media device.

The media handling component generates the samples of the waveform and provides the samples for processing. It will be appreciated that a waveform refers to a graphical representation of a signal, wherein the graphical representation is a function of time. Moreover, a sample of the waveform refers to a point in space having a set amplitude at a given time. Specifically, sampling of the waveform digitizes the waveform, when the waveform is a continuous-time signal. More specifically, a sequence of the samples of the waveform represents the waveform as a discrete-time signal.

In one embodiment, the media handling component acquires a value of the waveform, at every 'T' second, for sampling thereof. Herein, the 'T' seconds form the sampling interval for the waveform. In an example, the sampling interval for sampling of the waveform is 0.2 seconds. In another example, the sampling interval for sampling of the waveform is 2 seconds. More optionally, the media handling component employs a sampling unit that converts a continuous-time signal of the waveform into a discrete-time signal. Furthermore, in an embodiment, the samples of the waveform are characterized based on at least one of: a shape, an amplitude, a time period, a frequency.

In an embodiment, the media handling component acquires the waveform from any one of: an external database, an internal memory. Specifically, the external database is an organized body of digital information regardless of the manner in which data or the organized body thereof is represented. In an embodiment, the database may be hardware, software, firmware, or any combination thereof. It will be appreciated that the media handling component employs a data communication network to acquire the waveform from the external database. Moreover, in an embodiment, the media handling component acquires the waveform from the internal memory of the mobile media device or the media handling component.

The waveform comprises an audio signal having both the real component and the imaginary component. Moreover, the audio signal is processed to generate a transformed output audio signal having separated the real component and the imaginary component. Notably, the real component of the audio signal refers to the cosine signal waveform; and the imaginary component refers to sine signal waveform.

In an embodiment, the method comprises receiving samples of a first waveform on a first channel and samples of a second waveform on a second channel. In this regard, the media processing component is further configured to receive samples of the first waveform on the first channel and samples of the second waveform on the second channel.

It will be appreciated that the first waveform is sampled into a first set of samples and the second waveform is sampled into a second set of samples. Beneficially, providing different portions of the waveform to different channels (specifically, the first waveform to the first channel and the second waveform to the second channel) enables retention of multiple phase components for the waveform that are presented to the user using different output channels.

In this regard, the media handling component generates the first set of samples corresponding to the first waveform and the second set of samples corresponding to the second waveform.

The method comprises initializing the biquad filter with the set of one or more coefficients corresponding to the set of one or more stages of the biquad filter for both the real component of the samples and the imaginary component of the samples. The biquad filter is implemented on the media processing component of the mobile media device. Specifically, the biquad filter is a second order infinite-impulse response (IIR) filter. More specifically, the biquad filter is a digital filter having two poles and two zero's. Pursuant to embodiments of the present disclosure, the biquad filter is implemented to perform transforms on the samples of the waveform. In this regard, optionally, parallel pairs of one or more serially-cascaded biquad filters are configured to generate the transformed output signal (namely, the output) corresponding to the samples of the waveform.

Notably, the Hilbert transform is a mathematical operation (or, mathematical construct) to be performed on the samples of the waveform. The Hilbert transform performs bi-phasic application of separation of the samples of the waveform into corresponding real components and imaginary components. Specifically, a signal (u(t)) is convoluted with a function (h(t)=1/(wt)) to generate a Hilbert transform of the signal. Mathematically, Hilbert transform for the signal is given by:

wherein u(t) is the signal, p.v. is Cauchy principal value, and

T is an instant of time such that the Hilbert transform is not possible as an ordinary improper integral at T=t.

In practice, the Hilbert transform generates the signal H (u)(t) for the signal u(t) by shifting phase (namely, phase transformation) of the signal u(t) by $\pm\overline{w}/2$. Typically, for a sine input signal, a phase transformed signal for the input signal is a cosine signal, wherein the cosine signal forms a real component for the input signal and the sine signal forms an imaginary component for the input signal. Hilbert transforms on the samples of the waveform enable identification of a real component and an imaginary component for each of the samples of the waveform. It will be appreciated that the imaginary component of a sample is complementary to real component of the sample.

Notably, the biquad filter is optimized to perform similar operations to that of the Hilbert transform, namely, transformation of the samples of the waveform for bi-phasic separation thereof. The biquad filter is constructed in a manner to use a two-sample feedback mechanism. The said two samples are used immediately and stored to be used again later. The two stored samples comprise input samples represented as X−1 and X−2 and corresponding output samples Y−1 and Y−2. Moreover, the input sample X−2 and the output sample Y−2 are stored in a first input node and a first output node, respectively. Additionally, the input sample X−1 and the output sample Y−1 are stored in a second input node and a second output node, respectively. Notably, a node is a memory element associated with at least one of: the biquad filter, the mobile media device, the media processing device. Additionally, the second input node and the second output node succeeds the first input node and the first output node, respectively. Furthermore, for a newly arrived input sample X0, the biquad filter produces output sample Y0 which is stored in a third input node and a third output node, to be used again. In this regard, the output sample Y0 is produced based on the input samples (X0, X−1, X−2), the output samples (Y−1, Y−2) and the set of one or more coefficients (a0, a1, a2, b1 and b2) corresponding to the set of one or more stages of the biquad filter. Mathematically, the generation of the output sample Y0 using the set of one or more coefficients is represented as:

$$Y[n]=a0\cdot x(n)+a1\cdot x[n-1]+a2\cdot x[n-2]+b1\cdot y[n-1]+b2\cdot y[n-2];$$

Hence, $$Y0=a0\cdot X0+a1\cdot X-1+a2\cdot X-2+b1\cdot Y-1+b2\cdot Y-2;$$

wherein a0, a1 and a2 are coefficients for the biquad filter for the input samples X0, X−1 and X−2, respectively; and b1 and b2 are coefficients for the biquad filter for the output samples Y−1 and Y−2, respectively.

At a given instant, X0 is the newly arrived input sample that is processed to generate output sample Y0, wherein Y0 is generated based on feedback from stored samples X−1, X−2, Y−1 and Y−2. At a subsequent instant, the newly arrived input sample is X+1. Subsequently, output sample Y+1 is generated based on stored samples X0, X−1, Y0, and Y−1.

It will be appreciated that transformation of the samples of the waveform is performed in several stages. In this regard, an output sample of a first stage is provided as an input sample to a second stage. Subsequently, coefficients for each of several stages (namely, the set of one or more stages) may or may not be different. Furthermore, the output sample generated by a last stage is stored to constitute the output signal for the waveform.

Pursuant to embodiments of the present disclosure, the samples of the waveform are provided as input samples to the biquad filter, wherein the biquad filter performs transforms on each of the samples of the waveform. Moreover, the transformation of the samples of the waveform is performed to achieve bi-phasic separation of each of the samples into a corresponding real component and an imaginary component. Herein, the real component for a sample is the cosine signal associated with the sample and imaginary component is the sine signal associated with the sample. Moreover, transformation of the samples of the waveform for bi-phasic separation thereof is performed in several stages (namely, the set of one or more stages) of the biquad filter.

Specifically, the biquad filter is initialized with the set of one or more coefficients (namely, a0, a1, a2, b1 and b2) corresponding to each of the set of one or more stages (namely, stages 1-4) for generation of real component of the samples of the waveform and imaginary component of the samples of the waveform. More specifically, the set of one or more coefficients for the real component is different from the set of one or more coefficients for the imaginary component. The biquad filter, comprising of parallel pairs of serially-cascaded biquad filters, is initialized by passing the set of one or more coefficients corresponding to the set of one or more stages and the samples of the waveform. Subsequently, optionally, a first biquad filter entity is initialized for generating the real component of the samples and a second biquad filter entity is initialized for generating the imaginary component of the samples, wherein the real component and the imaginary component are combined to form the output.

In accordance with the present disclosure, values for the set of one or more coefficients corresponding to the set of one or more stages of the biquad filter are described herein below. Moreover, the biquad filter initialized with a set of one or more coefficients corresponding to the set of one or more stages for imaginary component shifts an input sample by 90 degrees. Additionally, the biquad filter initialized with a set of one or more coefficients corresponding to the set of one or more stages for real component offsets the input sample in time to preserve phase integrity, for example, between a first channel and a second channel from where the output sample will be presented.

The biquad filter is initialized for the real component with values of the set of one or more coefficients (namely, a0, a1, a2, b1 and b2) for four stages as presented in Table 1. Preferably, the values of the set of one or more coefficients (namely a0, a1, a2, b1, b2) are in the range of minimum to maximum value for four stages as presented in Table 1.

TABLE 1

| | a0 | | a1 | | a2 | | b1 | | b2 | |
|---|---|---|---|---|---|---|---|---|---|---|
| Stage | Min | Max | Min | Max | Min | Max | Min | Max | Min | Max |
| Stage 1 | 0.13587672 | 0.18763928 | 0 | 0 | −1.16 | −0.84 | 0 | 0 | −0.18763928 | −0.13587672 |
| Stage 2 | 0.61574436 | 0.85031364 | 0 | 0 | −1.16 | −0.84 | 0 | 0 | −0.85031364 | −0.61574436 |
| Stage 3 | 0.794094 | 1.096606 | 0 | 0 | −1.16 | −0.84 | 0 | 0 | −1.096606 | −0.794094 |
| Stage 4 | 0.83210232 | 1.14909368 | 0 | 0 | −1.16 | −0.84 | 0 | 0 | −1.14909368 | −0.83210232 |

Furthermore, the biquad filter is initialized for the imaginary component with values of the set of one or more coefficients (namely, a0, a1, a2, b1 and b2) for four stages as presented in Table 2. Preferably, the values of the set of one or more coefficients (namely a0, a1, a2, b1, b2) are in the range of minimum to maximum value for four stages as presented in Table 2.

TABLE 2

| | a0 | | a1 | | a2 | | b1 | | b2 | |
|---|---|---|---|---|---|---|---|---|---|---|
| Stage | Min | Max | Min | Max | Min | Max | Min | Max | Min | Max |
| Stage 1 | 0.40269684 | 0.55610516 | 0 | 0 | −1.16 | −0.84 | 0 | 0 | −0.55610516 | −0.40269684 |
| Stage 2 | 0.73602312 | 1.01641288 | 0 | 0 | −1.16 | −0.84 | 0 | 0 | 1.01641288 | −0.73602312 |
| Stage 3 | 0.82034316 | 1.13285484 | 0 | 0 | −1.16 | −0.84 | 0 | 0 | −1.13285484 | −0.82034316 |
| Stage 4 | 0.8379 | 1.1571 | 0 | 0 | −1.16 | −0.84 | 0 | 0 | −1.1571 | −0.8379 |

In an experimental observation, it was verified that the aforementioned set of one or more coefficients corresponding to the set of one or more stages for the biquad filter, enables accurate representation of phase dynamics of the transform. Moreover, this result was achieved by comparing two phase responses of a sine wave using a digital oscilloscope, across a range of frequencies. In some embodiments, the two-phase responses for the sine wave are circular in shape indicating that a phase transform of the sine wave is uniformly 90 degrees. Herein, a first phase response is generated mathematically by employing a Hilbert transform and a second phase response is generated by employing biquad filter. Furthermore, it was observed that circular shape of the first phase response begins to distort at higher frequencies, thereby indicating that the phase transformation of the sine wave is no more uniform using the Hilbert transform. However, the biquad filter initialized with the set of one or more coefficients corresponding to the set of one or more stages retains pure circular shape on the digital oscilloscope even at the Nyquist frequency for the sine wave, thereby indicating an improvement in quality of the phase transformation of the sine wave, and hence for any given sample of the waveform.

Beneficially, the aforementioned set of one or more coefficients corresponding to the set of one or more stages for the real component and the imaginary component enable swift transformation of the samples of the waveform across a very broad frequency range. Moreover, the biquad filter when operated based on the set of one or more coefficients enables the bi-phasic display of an oscilloscope to present the samples of the waveform as a pure circular form (namely, shape) for frequency of samples of the waveform in a range of 0 to Nyquist frequency. In other words, the biquad filter when operated based on the set of one or more coefficients performs phase transformation on the samples of the waveform. Notably, Nyquist frequency is half of a sampling rate at which the samples of the waveform are generated. Moreover, sampling rate refers to number of samples in a second.

The media management unit is configured to initialize the biquad filter with the set of one or more coefficients corresponding to the set of one or more stages of the biquad filter for generation of the real component of the samples and the imaginary component of the samples. Notably, the media management unit is a computational element configured to perform the steps of the method, specifically, initialize the biquad filter. In an embodiment, the media management unit is implemented in conjunction with the one or more processors of the mobile media device and/or media handling component. In a further embodiment, the media management unit is implemented as a set of instructions onto the one or more processors of the mobile media device.

Furthermore, the biquad filter is implemented on the media processing component of the mobile media device. The media processing component is coupled to the media management unit and the media handling component to enable communication of data therebetween. It will be appreciated that the media processing device is a computational element having processing ability or a set of instructions implemented in conjunction with the one or more processors of the mobile media device, media management unit and/or media handling component. Beneficially, the biquad filters are optimized in a manner to reduce consumption of processing power and energy during implementation thereof.

Moreover, in an embodiment, the media processing component places the samples of the waveform in an input array (namely, input buffer). The input buffer operates as a buffer before providing a sample from the samples of the waveform to the biquad filter as an input sample for processing thereto.

In an embodiment, the method comprises initializing the biquad filter with a first set of one or more coefficients processing the first set of samples and initializing the biquad filter with a second set of one or more coefficients for processing the second set of samples. More optionally, the first set of one or more coefficients and the second set of one or more coefficients comprise the set of one or more coefficients completely or partially. It will be appreciated that the set of one or more coefficients comprise values for coefficients (a0, a1, a2, b1 and b2) corresponding to one or more stages for the real component and the imaginary component. Subsequently, optionally, a biquad filter entity coupled to the first channel receiving the first set of samples, is initialized with the first set of one or more coefficients. Alternatively, a biquad filter entity coupled to the second channel receiving the second set of samples, is initialized with the second set of one or more coefficients. Moreover, optionally, the biquad filter entities are configured parallelly for operation of the biquad filter. It will be appreciated that both the biquad filter entities comprise a first biquad filter entity for the real component and a second biquad filter entity for the imaginary component.

Furthermore, the method comprises applying the biquad filter to the samples of the waveform to generate the output for presentation to the user. The output comprises the processed rendering of the real component of the samples and the imaginary component of the samples. Specifically, the media processing component is configured to apply the biquad filter, initialized with the set of one or more coefficients corresponding to the set of one or more stages for the real component and the imaginary component, for the samples of the waveform. The samples are transformed to generate output (namely, output samples), wherein an output corresponding to an input sample is a signal that is a summation of the real component and imaginary component of the input sample. It will be appreciated that a summation of output samples for each of the input samples form the output signal to be presented to the user. Optionally, the samples of the waveform are provided as input samples to the biquad filter, successively, from the input buffer. Moreover, optionally, the output signal renders the information associated with the waveform in different phases.

Typically, the output signal for the waveform is generated by incrementally mixing the imaginary component of each sample with the corresponding real component. Therefore, effectively, the number of components in the output signal is double as compared to the waveform provided as input, at any given instant of time. In other words, the output signal comprises an increased number of phase components from the waveform.

Optionally, the media processing component places (namely, stores) the output samples corresponding to each of the input samples in an output array. More optionally, the output array (namely, output buffer) operates as an output buffer prior to presenting the output samples to the user in a continuous manner.

In an embodiment, the real component and the imaginary component of the waveform are presented to the user using different output channels, wherein the output channels are output sources having different locations with respect to each other and the user.

In an embodiment, applying the biquad filter further comprises performing a differential transform on the input samples using a subtraction operation on a plurality of historical samples stored in an input buffer. In this regard, the media processing component is further configured to perform a differential transform on the input samples using a subtraction operation on a plurality of historical samples stored in an input buffer. Specifically, the input buffer is an array configured to store input samples to be provided to the biquad filter with sufficient delay along with the historical samples (namely, X−1, X−2, Y−1 and Y−2) as explained above. Furthermore, historical samples comprise input samples (X−1, and X−2) and corresponding output samples (Y−1, Y−2) that have been previously provided to the biquad filter for processing. It will be appreciated that the biquad filter initialized with the set of one or more coefficients and historical samples, uses a two-sample feedback mechanism to apply the biquad filter to the input sample to generate the output sample.

In an embodiment, the historical samples may be previously provided input samples and corresponding output samples from the samples of the waveform, input samples and corresponding output samples from a previously processed sample, or a combination thereof. Moreover, the differential transform for an input sample calculates the difference between an input vector corresponding to the input sample and another input vector corresponding to a first historical sample comprising input sample and output sample associated therewith. The difference is mapped as an output vector and used for analytical operations and to provide feedback to the biquad filter for generation of the output sample. Alternatively, optionally, the differential transform of the input samples is performed using mathematical functions, for example, Laplace transform function, Z-transform function, Fourier transform function, and the like.

In an embodiment, applying the biquad filter further comprises incrementally mixing the imaginary component with the real component by multiplying the samples stored in a differential transform buffer by an integration balance variable. In this regard, the media processing component is further configured to incrementally mix the imaginary component with the real component by multiplying the samples stored in a differential transform buffer by an integration balance variable. Notably, such mixing of the imaginary component with the real component enables controlling how the waveform changes as the imaginary component is introduced thereto. It will be appreciated that mixing the imaginary component with the real component allows the user to experience cognitive effects owing to different levels of phase information (namely, phase components). Specifically, samples stored in the differential transform buffer are multiplied with the integration balance variable.

In an embodiment, the method comprises applying the biquad filter to the first set of samples and the second set of samples to generate a first output on a first output channel and a second output on a second output channel. Specifically, the media processing component is further configured to apply the biquad filter to the first set of samples and the second set of samples to generate a first output on a first output channel and a second output on a second output channel. In this regard, the first set of samples (corresponding to the first waveform) and the second set of samples (corresponding to the second waveform) are processed with the biquad filter entities corresponding thereto. The first output generated by the biquad filter entity corresponding to the first input channel and employing the first set of one or more coefficients is communicated to the first output channel. The second output generated by the biquad filter entity corresponding to the second input channel and employing the second set of one or more coefficients is communicated to the second output channel. Notably, information rendered by the first output is different from information rendered by the second output. Moreover, optionally, the first output is stored in an output array associated with the first output channel and the second output is stored in an output array associated with the second output channel. Additionally, the first output (transformation of the first waveform) comprises separated real and imaginary components associated with the first waveform. Similarly, the second output (transformation of the second waveform) comprises separated real and imaginary components associated with the second waveform. Moreover, the first output in conjunction with the second output renders information of the waveform, for different phases, to the user.

In an embodiment, the first output comprises a processed rendering of the real component of the first set of samples and the imaginary component of the first set of samples. Specifically, the first set of samples comprise a real component and imaginary component associated therewith. Subsequently, the real component of the first set of samples is passed through a biquad filter entity initialized with first set of one or more coefficients for real component and the imaginary component of the first set of samples is passed through a biquad filter entity initialized with first set of one or more coefficients for the imaginary component. Additionally, the processed first set of samples is presented to the user via the first channel. Moreover, optionally, the second output comprises a processed rendering of the real component of the second set of samples and the imaginary component of the second set of samples. Specifically, the second set of samples comprise a real component and imaginary component associated therewith. Subsequently, the real component of the second set of samples is passed through a biquad filter entity initialized with second set of one or more coefficients for the real component and the imaginary component of the second set of samples is passed through a biquad filter entity initialized with second set of one or more coefficients for the imaginary component. Additionally, the processed real component and the imaginary component of the second set of samples is presented to the user via the second channel. It will be appreciated that the first channel renders phase components of the waveform slightly, partially or completely different from phase components rendered by the second channel.

In an embodiment, for the samples of the waveform corresponding to the audio signal, the biquad filter performs a phase transformation for the audio signal such that the transformation is uniform for all the samples of the audio signal according to their frequency. Beneficially, uniform transformation of the audio signal into a signal comprising a separated real component and imaginary component ensures an improved cognitive effect for the user thereby providing an immersive audio experience to the user. It will be appreciated that the original audio signal is produced by an audio source. Moreover, bi-phasic separation of the audio signal ensures that phase components of the audio signal are not locked together. Therefore, the transformed audio signal provides a live feeling, when presented to the user. Furthermore, optionally, the real and imaginary components of the audio signal, providing different phase information, are separately presented to opposite stereo channels, thereby forcing brain of the user to resolve the difference between them. Such brain activity leads to an illusion of a multi-directional source of the audio signal thereby giving a live feeling to the user.

In an embodiment, the increased number of phase components in the output signal increases amplitude (therefore, volume) of the output signal by 3 decibels (dB), when the waveform is an audio signal. In such cases, an increase in amplitude, when the amplitude of the real component and amplitude of the imaginary component is 1, is calculated using:

$$\text{Magnitude}=\text{sqrt}(r2+i2),$$

$$\text{So, sqrt}(12+12)=\sim 1\cdot 414.$$

$$\text{Moreover, Decibels (dB)}=20*\log 10(1\cdot 414)$$

$$\sim +3\text{ dB}$$

In an embodiment, the method further comprises modifying a magnitude of the output to prevent distortion of the output during presentation. In this regard, the media processing component is further configured to modify the magnitude of the output to prevent distortion of the output during presentation. Typically, such distortion is caused due to gain of the output signal being higher than the maximum allowed level. Notably, an increase in amplitude of the output signal that is already at a maximum amplitude results in clipping distortion in the output signal, specifically, for the audio signal. Therefore, gain of the output signal is controlled to prevent distortion of the output signal. In this regard, the gain of the output signal is attenuated by $(1/\sqrt{2})$. This attenuation allows mixing of the separated real component and the imaginary component of the samples, thereby allowing the addition of additional phase components to the output signal without any clipping or distortion. In this regard, optionally, the output buffer storing the output samples is multiplied by the aforementioned gain factor $(1/\sqrt{2})$.

Furthermore, In an embodiment, a ramp to fade function is applied to at least one of: the output buffer, the input buffer, for transformation of the output signal. Notably, treating the input buffer and/or the output buffer with the ramp to fade function prevents occurrence of clicks when the processor implementing the steps of the method is switched on and off. Beneficially, applying the ramp to fade function in the input buffers and/or the output buffer avoids unwanted crackling of the output signal between operational cycles.

In an embodiment, the mobile media device is an Apple device. In such case, the Apple Accelerate framework is employed to execute the aforementioned steps of the method. The Apple Accelerate framework provides high-performance, energy efficient computation on a processor of the mobile media device (namely, processor of the Apple device) by leveraging the vector-processing capability thereof. Specifically, code written for the Apple device provides energy-efficient computation that executes appropriate instructions for processor available at runtime of the method. Therefore, the Apple Accelerate framework is optimized for high-performance large-scale mathematical computations at low energy consumption. The Apple Accelerate framework is designed (specifically, programmed) to perform a wide range of functions, for example, image processing functions (vImage), digital signal processing functions (vDSP), arithmetic and transcendental functions (vForce), linear algebra functions (Sparse Solvers, BLAS, LAPACK), neural network functions (BNNS), and so forth. Moreover, the Apple AudioToolbox and Apple AVFramework are employed in conjunction with the Apple Accelerate framework to execute the steps of the method for processing an audio signal. In this regard, the AudioToolbox acquires the waveform from a database (namely, Apple Operating System) and generates samples of the audio signal. The AudioToolbox further provides the samples of the audio signal to the Accelerate framework, for processing of the samples. Moreover, the AVFramework provides a mechanism allowing the user to control playback of the audio signal using typical functions such as, for example, 'play', 'pause' 'next', 'previous', and the like.

In such embodiment, the biquad filter is implemented within the Accelerate framework, wherein the biquad filter is optimized specifically for Apple hardware. In this regard, the set of instructions (namely, algorithms) for executing the steps of the method are transformed to high-performance and low energy consuming algorithms, thereby allowing signal processing logic associated with the set of instructions to run extremely quickly on Apple devices without any noticeable latency. Notably, the vDSP library within the Accelerate framework contains a collection of highly optimized functions for digital signal processing and general-purpose arithmetic operations on large arrays. Combinations of operations associated with the vDSP function include, but are not limited to, Fourier transform, biquadratic filtering, multiplication, addition, sum, mean and maximum. The samples of the audio signal are received by the Accelerate framework from the Audio Toolbox. Moreover, the biquad filter for processing of the audio signal is initialized as:

biquadSetup=vDSP_biquadm_CreateSetup (coeffsReal, n BiquadStages, n InputOutputChannels).

Such setup is repeated for each set of one or more coefficients for the real component of the samples and each set of one or more coefficients for the imaginary component of the samples; and for both left and right channels associated with the mobile media device (namely, Apple device). Herein, the left are right channels are locations for presentation of the output. Moreover, the left and right channel may correspond to the left and right speaker of an earphone, a sound system, and the like, connected with the Apple device. Once the biquad filter is initialized, the samples of the audio signal are processed with the biquad filter. Moreover, the samples of the audio signal are stored in the input buffer, wherein the input buffer further provides the samples of the audio signal to the biquad filter in a sequence and with delay. Moreover, the input buffer ensures that a first set of samples is provided to a first channel (for example, left channel) and a second set of samples is provided to a second channel (for example, right channel). Furthermore, the biquad filter, wherein the biquad filter is a serially-cascaded filter, is applied with a set of one or more coefficients for the set of one or more stages (specifically, four stages) to process the samples of the audio signal, wherein the samples of the audio signal are specified by the 'inputBuffer'. A function used to apply the biquad filter is:

vDSP_biquadm (biquadSetup, &inputBuffer, inputStride, &outputBuffer, outputStride, nElements).

Furthermore, output obtained by passing the input samples through the biquad filter is placed in an array specified by 'outputBuffer'. Moreover, optionally, the input samples in the input buffer are differentially transformed using the subtraction operation of the vDSP function. In this regard, the subtraction is performed using vDSP command:

vDSP_vsub (inputBufferA, strideA, inputBufferB, strideB, differentialOutputBufferC, strideOutput, frames).

Moreover, the output buffer stores output generated by the biquad filter corresponding to input provided to the biquad filter. The output buffer is operated using vDSP command:

vDSP_vsub (inputBufferA, strideA, inputBufferB, strideB, temporalOutputBufferC, strideOutput, frames).

Furthermore, the gain of the output buffer is multiplied by gain factor ($1/\sqrt{2}$) to prevent distortion of the output audio signal at higher amplitude of the audio signal. vDSP command used for the multiplication is:

vDSP_vsmul (inputBuffer, inputStride, &gain, outputBuffer, outputStride, frames).

Additionally, the input buffer and/or the output buffer is applied with a ramp to fade function to prevent crackling of the output audio signal. vDSP command for the same is:

vDSP_vrampmul2 (bufferToFadeIn[0], bufferToFadeIn[1], 1, &fadeInStart, &fadeInStep,bufferToFadeIn[0], bufferToFadeIn[1], 1, frameCount);

vDSP_vadd (bufferToFadeOut[0], 1, bufferToFadeIn[0], 1, outputBuffer[0], 1, frameCount).

In an embodiment, the media management unit is further configured to initialize the biquad filter with a first set of one or more coefficients processing the first set of samples and initializing the biquad filter with a second set of one or more coefficients for processing the second set of samples.

DETAILED DESCRIPTION OF THE DRAWINGS

Referring to FIG. 1, illustrated is a schematic illustration of a flow chart 100 depicting steps of a method of presenting information to a user, in accordance with an embodiment of the present disclosure. The method for presenting information to the user is implemented via a mobile media device comprising a media handling component, a media management unit and a media processing component. At a step 102, samples of a waveform are received from the media handling component of the mobile media device. At a step 104, a biquad filter is initialized with a set of one or more coefficients corresponding to a set of one or more stages of the biquad filter for both a real component of the samples and an imaginary component of the samples. The biquad filter is implemented on the media processing component of the mobile media device. At a step 106, the biquad filter is applied to the samples of the waveform to generate an output for presentation to the user. The output comprises a processed rendering of the real component of the samples and the imaginary component of the samples.

Figure 2:
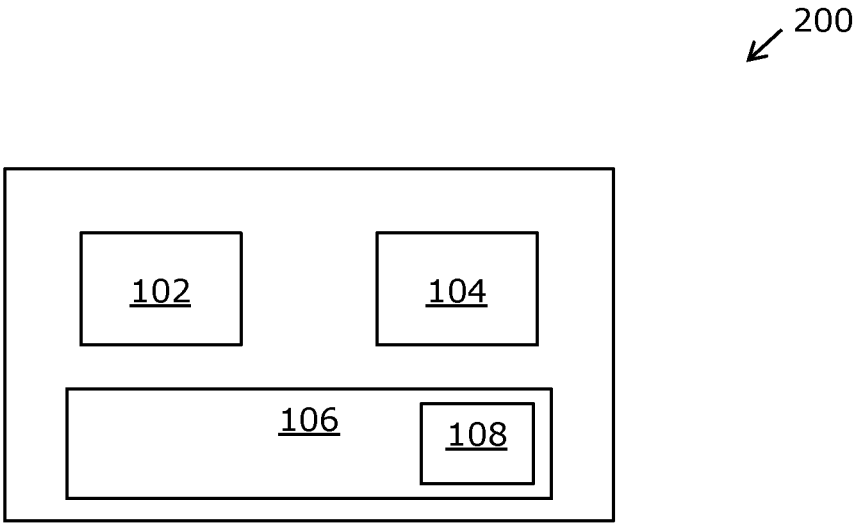
FIG. 2 is a schematic illustration of a mobile media device for presenting audio information to a user.

Referring to FIG. 2, illustrated is a schematic illustration of a mobile media device 200 for presenting information to a user, in accordance with an embodiment of the present disclosure. As shown, the mobile media device 200 comprises a media handling component 202, a media management unit 204, and a media processing component 206, wherein a biquad filter 208 is implemented on the media processing device 206. The media handling component 202 is configured to generate samples of a waveform. Moreover, the media management unit 204 is configured to initialize the biquad filter 208 with a set of one or more coefficients corresponding to a set of one or more stages of the biquad filter for both a real component of the samples and an imaginary component of the samples. Furthermore, the media processing component 206 is coupled to the media management unit 204 and the media handling component 202. The media processing component 206 is configured to receive the set of one or more coefficients and to apply the biquad filter 208 to the samples of the waveform to generate an output for presentation to a user. The output comprises a processed rendering of the real component of the samples and the imaginary component of the samples.

Modifications to embodiments of the present disclosure described in the foregoing are possible without departing from the scope of the present disclosure as defined by the accompanying claims. Expressions such as "including", "comprising", "incorporating", "have", "is" used to describe and claim the present disclosure are intended to be construed in a non-exclusive manner, namely allowing for items, components or elements not explicitly described also to be present. Reference to the singular is also to be construed to relate to the plural.

The invention claimed is:

1. A method of presenting information to a user, comprising:

receiving samples of a waveform from a media handling component of a mobile media device;

initializing a biquad filter with a set of one or more coefficients corresponding to a set of one or more stages of the biquad filter for both a real component of the samples and an imaginary component of the samples, wherein the biquad filter is implemented on a media processing component of the mobile media device; and applying the biquad filter to the samples of the waveform to generate an output for presentation to the user, the output comprising a processed rendering of the real component of the samples and the imaginary component of the samples, wherein applying the biquad filter further comprises performing a differential transform on the input samples using a subtraction operation on a plurality of historical samples stored in an input buffer.

2. The method of claim 1, further comprising receiving samples of a first waveform on a first channel and samples of a second waveform on a second channel.

3. The method of claim 2, further comprising initializing the biquad filter with a first set of one or more coefficients processing the first set of samples and initializing the biquad filter with a second set of one or more coefficients for processing the second set of samples.

4. The method of claim 3, further comprising applying the biquad filter to the first set of samples and the second set of samples to generate a first output on a first output channel and a second output on a second output channel.

5. The method of claim 4, wherein the first output comprises a processed rendering of the real component of the first set of samples and the imaginary component of the first set of samples.

6. The method of claim 4, wherein the second output comprises a processed rendering of the real component of the second set of samples and the imaginary component of the second set of samples.

7. The method of claim 1, wherein the waveform comprises an audio signal having both the real component and the imaginary component.

8. The method of claim 1, wherein applying the biquad filter further comprises incrementally mixing the imaginary component with the real component by multiplying the samples stored in a differential transform buffer by an integration balance variable.

9. The method of claim 1, further comprising modifying a magnitude of the output to prevent distortion of the output during presentation.

10. A mobile media device for presenting information to a user, comprising:

a media handling component configured to generate samples of a waveform;

a media management unit configured to initialize a biquad filter with a set of one or more coefficients corresponding to a set of one or more stages of the bi quad filter for both a real component of the samples and an imaginary component of the samples; and a media processing component coupled to the media management unit and the media handling component, the media processing component configured to receive the set of one or more coefficients; and to apply the biquad filter to the samples of the waveform to generate an output for presentation to a user, the output comprising a processed rendering of the real component of the samples and the imaginary component of the samples, wherein the media processing component is further configured to perform a differential transform on the input samples using a subtraction operation on a plurality of historical samples stored in an input buffer.

11. The mobile media device of claim 10, wherein the media processing component is further configured to receive samples of a first waveform on a first channel and samples of a second waveform on a second channel.

12. The mobile media device of claim 11, wherein the media management unit is further configured to initialize the biquad filter with a first set of one or more coefficients processing the first set of samples and initializing the biquad filter with a second set of one or more coefficients for processing the second set of samples.

13. The mobile media device of claim 12, wherein the media processing component is further configured to apply the biquad filter to the first set of samples and the second set of samples to generate a first output on a first output channel and a second output on a second output channel.

14. The mobile media device of claim 13, wherein the first output comprises a processed rendering of the real component of the first set of samples and the imaginary component of the first set of samples.

15. The mobile media device of claim 13, wherein the second output comprises a processed rendering of the real component of the second set of samples and the imaginary component of the second set of samples.

16. The mobile media device of claim 10, wherein the waveform comprises an audio signal having both the real component and the imaginary component.

17. The mobile media device of claim 10, wherein the media processing component is further configured to incrementally mix the imaginary component with the real component by multiplying the samples stored in a differential transform buffer by an integration balance variable.

18. The mobile media device of claim 10, wherein the media processing component is further configured to modifying a magnitude of the output to prevent distortion of the output during presentation.

* * * * *